US005714107A

United States Patent [19]

Levy et al.

[11] Patent Number: 5,714,107

[45] Date of Patent: Feb. 3, 1998

[54] PERFORATED NONWOVEN FABRICS

[75] Inventors: Ruth Lisa Levy, Sugar Hill; Henry Louis Griesbach, III, Atlanta; Jay Sheldon Shultz, Roswell; La-Donna Lynn McCullar Bishop Brown, Alpharetta, all of Ga.

[73] Assignee: Kimberly-Clark Worldwide, Inc., Neenah, Wis.

[21] Appl. No.: 674,365

[22] Filed: Jul. 2, 1996

Related U.S. Application Data

[63] Continuation of Ser. No. 246,649, May 20, 1994, abandoned.

[51] Int. Cl.[6] ..... D02J 1/22

[52] U.S. Cl. ..... 264/289.3; 264/146; 264/288.8; 264/290.5

[58] Field of Search ..... 264/146, 288.8, 264/289.3, 290.5

[56] References Cited

U.S. PATENT DOCUMENTS

| | | | |
|---|---|---|---|
| T990,006 | 1/1980 | Williams | 428/131 |
| 1,148,359 | 7/1915 | Clapp . | |
| 3,494,821 | 2/1970 | Evans | 161/169 |
| 3,692,618 | 9/1972 | Dorschner et al. | 161/72 |
| 3,756,907 | 9/1973 | Heling | 162/114 |
| 3,790,652 | 2/1974 | Colijn et al. | 264/146 |
| 3,849,241 | 11/1974 | Butin et al. | 161/169 |
| 3,906,073 | 9/1975 | Kim et al. | 264/147 |
| 3,914,365 | 10/1975 | Kim et al. | 264/147 |
| 3,985,600 | 10/1976 | Blais | 156/229 |
| 4,144,368 | 3/1979 | Kim et al. | 428/105 |
| 4,340,563 | 7/1982 | Appel et al. | 264/518 |
| 4,469,734 | 9/1984 | Minto et al. | 428/134 |
| 4,560,372 | 12/1985 | Pieniak | 604/369 |
| 4,608,292 | 8/1986 | Lassen | 428/131 |
| 4,618,385 | 10/1986 | Mercer | 156/229 |
| 4,701,237 | 10/1987 | Lassen | 156/252 |
| 4,741,941 | 5/1988 | Englebert et al. | 428/71 |
| 4,791,685 | 12/1988 | Maibauer | 2/227 |
| 4,842,794 | 6/1989 | Hovis et al. | 264/145 |
| 4,886,632 | 12/1989 | Van Iten et al. | 264/156 |
| 4,908,026 | 3/1990 | Sukiennik et al. | 604/378 |
| 5,262,107 | 11/1993 | Hovis et al. | 264/145 |

FOREIGN PATENT DOCUMENTS

| | | |
|---|---|---|
| 0586924A1 | 3/1994 | European Pat. Off. . |
| 2175026 | 11/1986 | United Kingdom . |

OTHER PUBLICATIONS

Billmeyer, Jr., Fred W., Textbook of Polymer Science, 3rd Edition, p. 321, Dec. 1984.

*Primary Examiner*—Christopher Raimund
*Attorney, Agent, or Firm*—Michael U. Lee

[57] ABSTRACT

The invention provides a perforated nonwoven web fabricated from a bonded thermoplastic polymer web. The perforated nonwoven web contains a multitude of self-sustaining sustaining perforations that are substantially free of melt-fused edges and can be characterized as stretch-opened perforations. The invention further provides a process for producing the perforated nonwoven web.

10 Claims, 4 Drawing Sheets

PERFORATED NONWOVEN FABRICS

This application is a continuation of application Ser. No. 08/246,649 entitled "PERFORATED NONWOVEN FABRICS" filed in the U.S. Patent and Trademark Office on May 20, 1994 now abandoned. The entirety of this application is hereby incorporated by reference.

BACKGROUND OF THE INVENTION

The present invention is related to a perforated nonwoven fabric. More particularly, this invention is related to a slit-perforated nonwoven fabric of thermoplastic fibers.

Perforated nonwoven fabrics have been utilized in disposable articles, such as diapers, sanitary napkins, incontinence products and disposable garments. For example, U.S. Pat. No. 4,886,632 to Van Iten et al. discloses a sanitary napkin equipped with a facing layer of a perforated fluid permeable nonwoven web. The facing layer structurally contains the absorbent material of the napkin and protects the skin of the user from directly contacting the absorbent material. In addition, the facing layer is designed to rapidly transmit and keep body fluid away from the user's body. Such perforated nonwoven webs layers, which come in contact with the skin of the user, need to provide cloth-like texture and feel as well as fluid transferring functionalities.

One conventional method of forming perforated or apertured nonwoven webs is passing an unbonded fiber web through the nip formed by a set of intermeshing rolls which have three-dimensional projections to displace fibers away from the projections, forming apertures which conform to the outside contours of the base of the projections in the web. The apertured web is subsequently bonded to impart permanent physical integrity. This approach suffers from an inherent disadvantage in that the size and shape of the apertures strictly correspond to those of the projections on the intermeshing rolls, and thus different sets of intermeshing rolls are needed to produce perforated webs of different perforation sizes and shapes. Furthermore, the apertured unbonded web must be carefully subjected to a bonding process without disturbing the formed apertures.

Another conventional approach is to aperture nonwoven webs using an embossing roll assembly that physically punches a multitude of apertures in the webs. However, this approach also suffers from a number of disadvantages. Again, the size and shape of the apertures are strictly dependent on the size and shape of the raised points of the embossing rolls. In addition, the aperturing process wastes nonwoven fabrics by producing small pieces of waste cutouts. The cutouts not only need to be thoroughly dislodged from the fabrics but also create collection and disposal problems. Moreover, the high pressure applied on the raised points of the embossing rolls, which is required to effect the apertures, quickly wears or abrades portions of the raised points, reducing the aperturing efficacy of the raised points and thus necessitates frequent servicing of the embossing rolls. Although the service life of the embossing rolls can be extended by heating the rolls to assist the aperturing process, the combination of heat and pressure tends to produce apertures having hard melt-fused edges. Such melt-fused apertures deleteriously affect the texture and flexibility of the nonwoven webs by creating stiff and sharp edges.

Yet another approach is stretching a slitted unbonded or precursorily bonded nonwoven web containing adhesive fibers to open the slits and then heating the stretched web to melt or activate the adhesive fibers to form interfiber adhesion points throughout the web to permanently set the opened slits. This process requires the use of adhesive fibers and increases the complexity of the web production process. Moreover, the extent of stretch-opening of the slits in the web is severely limited in that the nonwoven web, which is stretched without being fully bonded, does not have enough physical integrity to tolerate high stretching tensions that are required to effect widely opened slits.

There is a continuing need to provide a process for perforating or aperturing nonwoven webs that is highly efficient, relatively simple and flexible to accommodate a wide range of needs for perforated nonwoven webs containing different sizes of apertures.

SUMMARY OF THE INVENTION

There is provided in accordance with the present invention a process for producing a perforated nonwoven web of a thermoplastic polymer having the steps of slitting a bonded nonwoven web in a predetermined pattern; heating the web to a temperature between the softening temperature of the thermoplastic polymer and about the onset of melting at a liquid fraction of 5%; tensioning the web in at least one planar direction of the slitted nonwoven web while maintaining the temperature of the web to form apertures; and cooling the apertured web while maintaining the tension, wherein the perforation process imparts the apertures without melt-fusing the fibers at the edge of the apertures. The perforated nonwoven web produced from the present process contains a multitude of self-sustaining perforations that are substantially free of melt-fusion and are stretch-opened perforations.

The perforated nonwoven webs of the present invention, which can be controlled to have non-fused perforations of different sizes and shapes, are highly useful for perforated layers of disposable articles. The non-fused perforations preserve the desirable texture and properties of the nonwoven web, making the perforated web highly useful in skin-contacting and fluid managing applications.

DETAILED DESCRIPTION OF THE INVENTION

Figure 1:
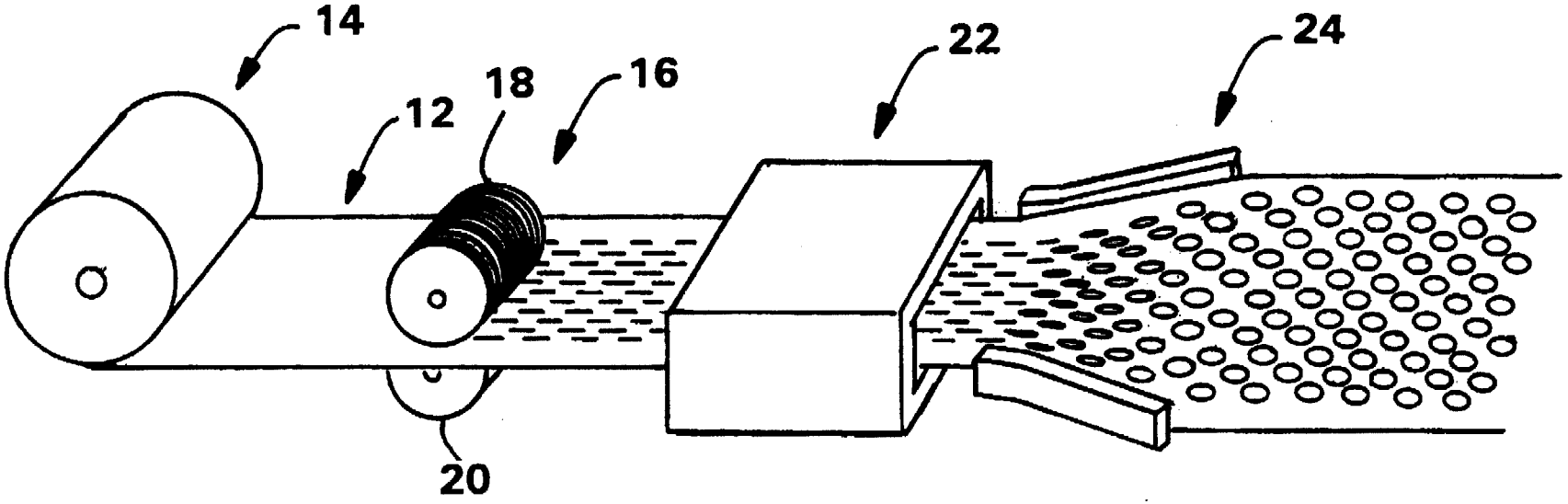
FIG. 1 illustrates an exemplary process for producing the perforated nonwoven web that heats the slit nonwoven web in an oven and stretches the slit nonwoven web in the cross-machine direction.

The present invention provides a process for producing perforated nonwoven webs of thermoplastic fibers. The process contains the steps of slitting a bonded nonwoven web in a predetermined pattern, heating the web to an appropriate temperature, tensioning the web in at least one planar direction to open the slits to form apertures, and cooling the web while maintaining the tension. The nonwoven web, in accordance with the present invention, is heated to a temperature between the softening temperature of the thermoplastic polymer and about the onset of melting at a liquid fraction of 5%. The softening temperature of a thermoplastic polymer can be determined in accordance with ASTM D-648 at 66 psi, the heat deflection temperature. The expression "onset of melting at a liquid fraction of 5%" refers to a temperature which corresponds to a specified magnitude of phase change in a generally crystalline or semicrystalline polymer near its melt transition. The onset of melting, which is determined using Differential Scanning Calorimetry techniques, occurs at a temperature which is lower than the melt transition and is characterized by different ratios of liquid fraction to solid fraction in the polymer. As an example, a polypropylene fiber web is desirably heated to a temperature between 200° F. and about 300° F. It is to be noted that when a multicomponent conjugate fiber web is utilized, the fibers of the web need to be heated to a temperature in which at least one of the components, most desirably all of the components, of the fibers needs to be at a temperature within the above-specified temperature criteria.

A suitable bonded nonwoven web can be slit with any method known to be suitable for slitting nonwoven webs. For example, a rotary die or a stamping die equipped with cutting blades is highly suitable. The size, the shape and the pattern of arrangement of the cutting blades can be varied widely. In accordance with the present invention, the slitting step of the present perforation process can be applied before or after the heating step.

There can be more than one tensioning step in the perforation process, and the tensioning step of the perforation process can also be applied before and/or after the heating step provided that the bonded web is slit before the final tensioning step. It is to be noted that if the tensioning step is applied after the heating step, the temperature of the nonwoven web should be maintained to a temperature above the softening temperature of the web. Since the slit nonwoven web is a fully bonded web, the web exhibits a high physical integrity that can withstand the high tensioning force which is required to provide a highly and uniformly opened or perforated web even when the web is not preheated to facilitate the stretching process. It has been observed that when an unheated slit nonwoven web is tensioned, the web tends to increase its bulk as the slits open up, imparting an enhanced soft texture.

As an alternative embodiment of the present invention, the slit web is heat treated to a temperature within the above-specified range before the tensioning force is applied since the slits of a heated web can be opened with a significantly less tensioning force and can be highly stretched to provide larger perforations.

The slit nonwoven webs can be heated with any known heating processes suitable for nonwoven fabrics. Suitable heating processes include oven heating, infrared heating, conduction heating and through-air heating processes. Of these suitable heating processes, through-air heating processes are particularly desirable in that these processes uniformly and rapidly heat treat nonwoven webs. Briefly described, a through-air heating process applies pressurized streams of heated air that pass through the nonwoven web, thereby uniformly and quickly heating the web. Although it may not be desirable for certain applications where bulky nonwovens are desired, the opened slits of a thermoplastic nonwoven web can be permanently set to a desired configuration by applying pressure, e.g., in the nip of calender rolls, in the absence of external heat to apply sufficient mechanical energy to set the perforations in the web.

Turning to FIG. 1 there is provided an exemplary process for producing the perforated nonwoven web of the present invention. A bonded nonwoven web 12 is supplied from a supply roll 14 to the nip formed by a slitting roll assembly 16, which contains a slitting roll 18 and a backing roll 20. Alternatively, the nonwoven web 12 can be formed directly in-line. The slitting roll 18 is equipped with a plurality of circumferentially arranged spaced-apart blades, in which the tips of the blades make intimate contact with the surface of the backing roll 20 at the nip to make a pattern of slits in the web. The blades having a thin elongated tip are arranged to have their long axis circumferentially around the roll 18 to make slits in the direction of advancement of the web. The slit web is then heated by passing the web through a heating device 22, e.g., an oven. The heated, slit web is stretched in the cross machine direction to open the slits. The stretching is performed, for example, by a tenter frame 24. The size and, to a limited degree, the shape of opening of the slits is controlled by the extent of stretching. The stretched nonwoven web is then cooled, i.e., cooled to a temperature below the softening temperature of the polymer, while retaining the tensioning force to permanently set the opened perforations.

Figure 2:
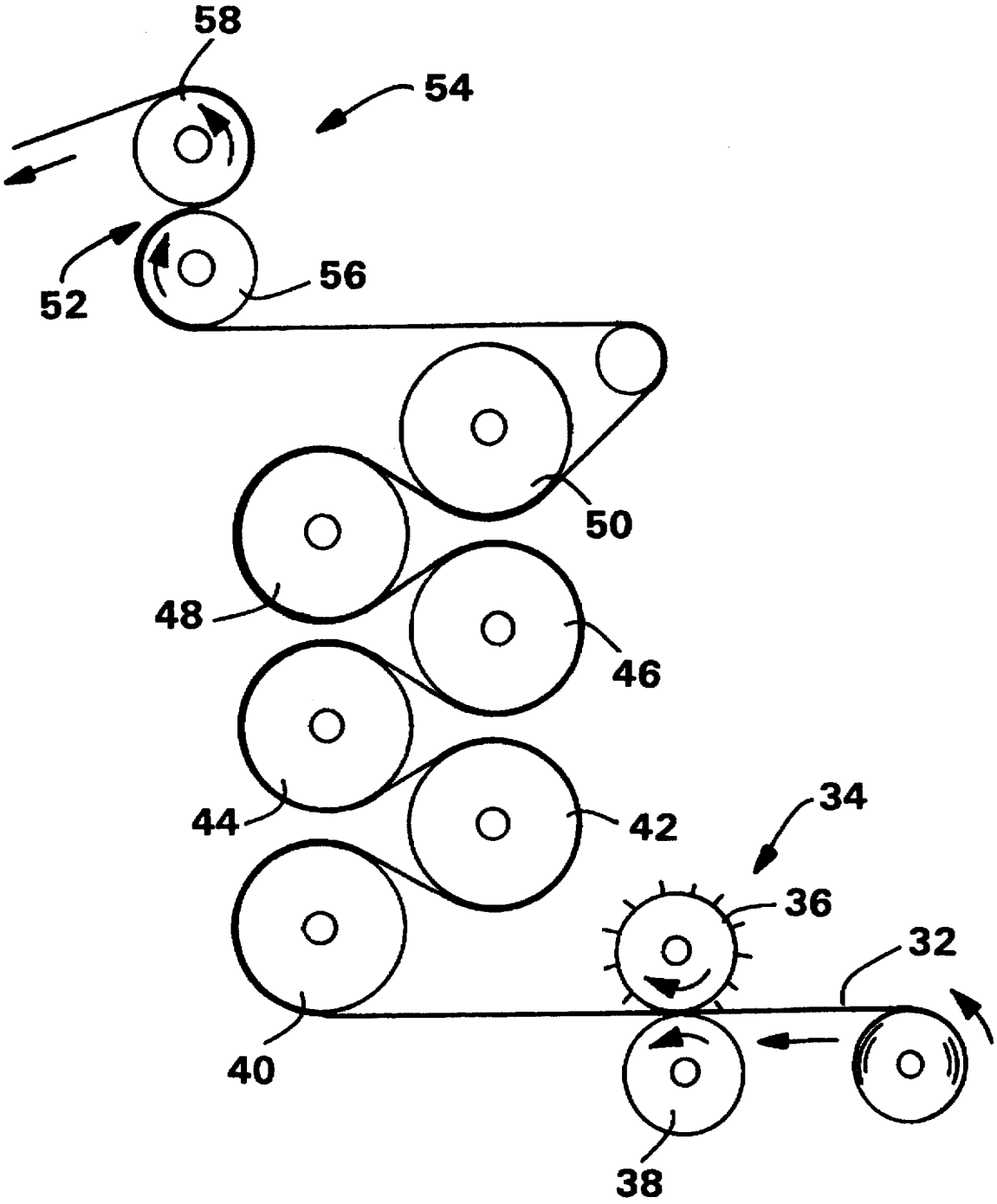
FIG. 2 illustrates an exemplary process for producing the perforated nonwoven web that heats the slit nonwoven web by a conduction heating process and stretches the slit nonwoven web in the machine direction.

FIG. 2 illustrates another exemplary process which applies the tensioning force in the machine direction. A nonwoven web 32 is supplied through the nip formed by a slitting roll assembly 34 of a slitting roll 36 and a backing roll 38. Unlike the slitting roll of the above-described cross-machine direction stretching process, the long axis of the blades of the slitting roll 36 are parallelly aligned to the rotating axis of the roll 36. The slit web is passed through a series of heating rolls 40–50 to heat the web to a desired level. From the heating rolls, the heated web passes through the nip 52 formed by an S-roll arrangement 54 in a reverse-S path. The S-roll arrangement 54 contains a set of drive rolls 56–58. The peripheral linear speed of the drive rolls 56–58 is controlled to be faster than the linear speed of the heating rolls 40–50 to apply a machine direction tensioning force to open the slits in the web. The tensioned web is cooled while maintaining the tensioning force to set the opened-slit configuration.

Although these exemplary processes are illustrated to have slits that are perpendicular to the tensioning direction, the angle formed between the long axis of the slits and the tensioning direction can be varied widely provided that the axis of the slits and the tensioning direction are not substantially parallel to each other so that the slits open to form perforations when the web is stretched. In addition, the shape and the size of the perforations can be changed and controlled by changing the direction and magnitude of the tensioning force.

Figure 3:
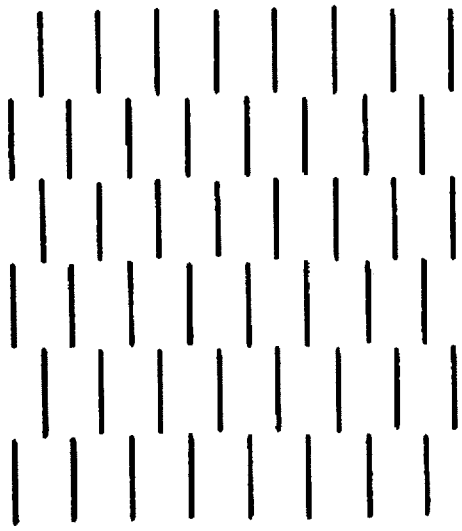
FIGS. 3–6 illustrate exemplary slit patterns suitable for the present invention.
Figure 4:
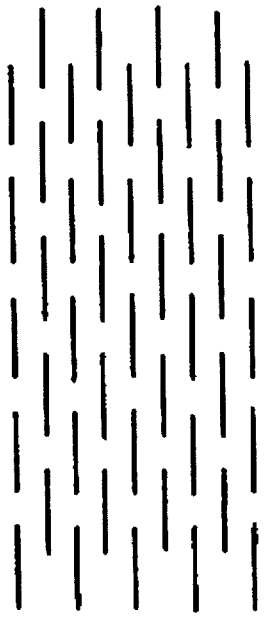

The size and shape of the slits in the nonwoven web can be varied widely by changing the size and the shape of the blades or the tips of the blades to provide different size and shape of perforations and to accommodate different applications and uses of the perforated webs. For example, the slits can be a multitude of straight lines or arcs. Additionally, the spacing between the blades can be varied to accommodate different needs and uses of the perforated webs. It is to be noted that the slits themselves can be small apertures when larger apertures or perforations are desired, although the disposal and fabric waste problems resulting from such configuration of slits make this approach not particularly desirable. In addition, the pattern of the slits can be varied widely. For example, the slits can have a regularly repeating, random, or non-uniform pattern. FIGS. 3–6 illustrate exemplary slit patterns suitable for the invention. FIG. 3 provides a non-overlapping slit pattern, and FIG. 4 provides an overlapping slit pattern that has a smaller horizontal distance between the slits than the distance of the pattern in FIG. 3.

Figure 5:
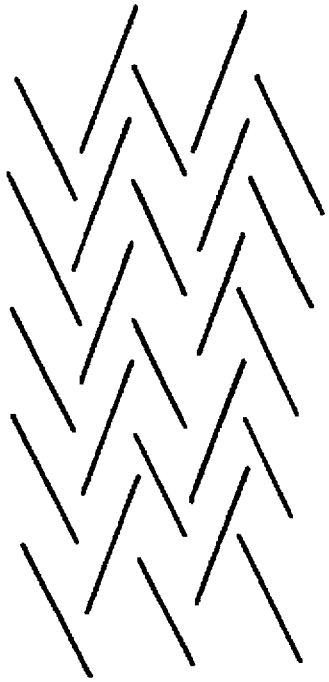
Figure 6:
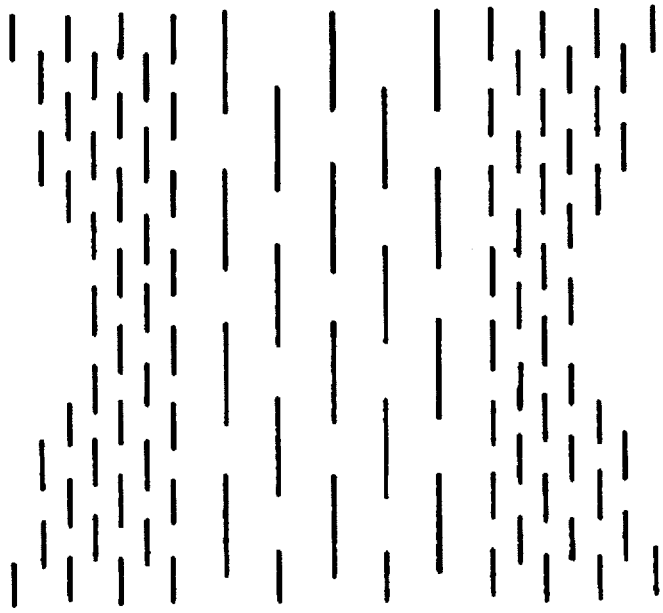
Figure 7:
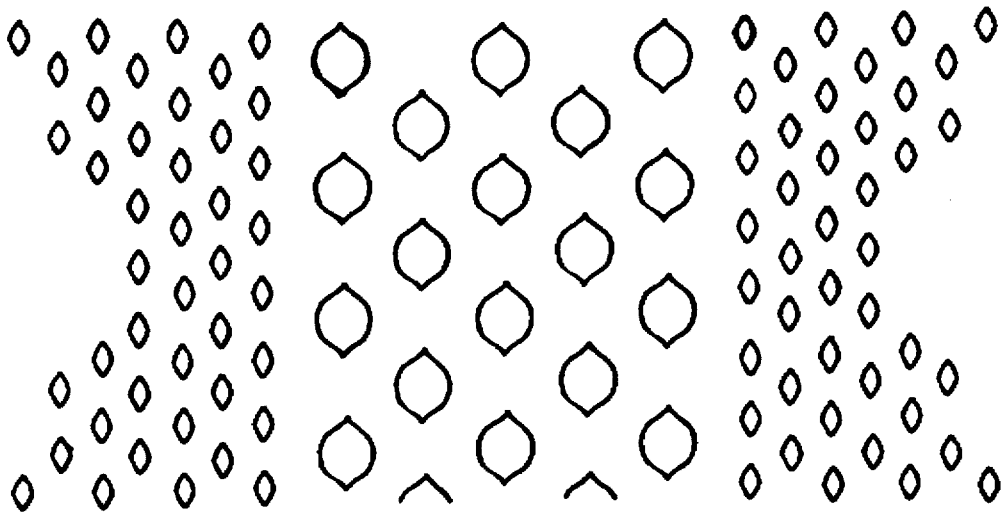
FIG. 7 is an exemplary stretch-opened perforation pattern.

FIG. 5 illustrates a slit pattern that has its slits aligned in a non-parallel fashion. FIG. 6 illustrates a symmetrical but non-uniform slit pattern which contains two different slit sizes. FIG. 7 illustrates a stretch-opened perforation pattern obtainable from the slit pattern of FIG. 6.

In accordance with the present invention, the heated slit nonwoven web can not only be subjected to a high tensioning force to open the slits but also be further tensioned to reduce the thickness of the web. Consequently, the present perforation process can also be utilized to control the thickness of the perforated nonwoven web.

Nonwoven fabrics suitable for the present invention are bonded thermoplastic fiber webs including melt-processed fiber webs, e.g., spunbond fiber webs and meltblown fiber webs; solution-processed fiber webs, e.g., solution sprayed fiber webs; needled fiber webs; hydroentangled fiber webs and carded staple fiber webs. The term "bonded" as used herein indicates having a multitude of permanent interfiber affixation points, which are created by thermal adhesion, mechanical entanglement or adhesive bonding, substantially uniformly distributed throughout the web so that the tensioning force to open the slits can be applied without pulling individual fibers apart from the web. The term "spunbond fiber web" as used herein refers to a nonwoven fiber web of small diameter fibers that are formed by extruding a molten thermoplastic polymer as filaments from a plurality of capillaries of a spinneret. The extruded filaments are partially cooled and then rapidly drawn or simultaneously drawn and cooled by an eductive or other well-known drawing mechanism. The drawn filaments are deposited or laid onto a forming surface in a random, isotropic manner to form a loosely entangled fiber web, and then the laid fiber web is subjected to a bonding process to impart physical integrity and dimensional stability. Bonding processes suitable for spunbond fiber webs are well known in the art, which include calender bonding, needle punching, hydroentangling and ultrasonic bonding processes for homopolymer spunbond fiber webs and calender bonding, needle punching, hydroentangling, ultrasonic bonding and through air bonding processes for conjugate spunbond fiber webs. The production of spunbond webs is disclosed, for example, in U.S. Pat. Nos. 4,340,563 to Appel et al. and 3,692,618 to Dorschner et al. Typically, spunbond fibers have an average diameter in excess of 10 μm and up to about 55 μm or higher, although finer spunbond fibers can be produced. Spunbond fibers tend to have a higher degree of molecular orientation and thus a higher physical strength than other melt-processed fibers. The term "carded staple fiber web" refers to a nonwoven web that is formed from staple fibers. Staple fibers are produced with a conventional staple fiber forming process, which typically is similar to the spunbond fiber forming process, and then cut to a staple length. The staple fibers are subsequently carded and bonded to form a nonwoven web. The term "meltblown fiber web" indicates a fiber web formed by extruding a molten thermoplastic polymer through a spinneret containing a plurality of fine, usually circular, die capillaries as molten filaments or fibers into a high velocity gas stream which attenuates or draws the filaments of molten thermoplastic polymer to reduce their diameter. In general, meltblown fibers have an average fiber diameter of up to about 10 μm. After the fibers are formed, they are carried by the high velocity gas stream and are deposited on a forming surface to form an autogenously bonded web of randomly dispersed, highly entangled meltblown microfibers. Such a process is disclosed, for example, in U.S. Pat. No. 3,849,241 to Butin. The term "hydroentangled web" refers to a mechanically entangled nonwoven web of continuous fibers or staple fibers in which the fibers are mechanically entangled through the use of high velocity jets or curtains of water. Hydroentangled nonwoven webs are well known in the art, and, for example, disclosed in U.S. Pat. No. 3,494,821 to Evans.

Suitable fibers for the present nonwoven webs can be produced from any known fiber-forming thermoplastic polymer, including crystalline polymers, semicrystalline polymers and amorphous polymers, and suitable fibers can be monocomponent fibers or multicomponent conjugate fibers containing two or more polymer components of different thermoplastic polymers or of a thermoplastic polymer having different viscosities and/or molecular weights. Suitable thermoplastic fibers include polyolefins, polyamides, polyesters, acrylic polymers, polycarbonate, fluoropolymers, thermoplastic elastomers and blends and copolymers thereof. Polyolefins suitable for the present nonwoven web include polyethylenes, e.g., high density polyethylene, medium density polyethylene, low density polyethylene and linear low density polyethylene; polypropylenes, e.g., isotactic polypropylene and syndiotactic polypropylene; polybutylenes, e.g., poly(1-butene) and poly(2-butene); polypentenes, e.g., poly(2-pentene), and poly(4-methyl-1-pentene); polyvinyl acetate; polyvinyl chloride; polystyrene; and copolymers thereof, e.g., ethylene-propylene copolymer; as well as blends thereof. Of these, more desirable polyolefins are polypropylenes, polyethylenes and copolymers thereof; more particularly, isotactic polypropylene, syndiotactic polypropylene, high density polyethylene, and linear low density polyethylene. Suitable polyamides include nylon 6, nylon 6/6, nylon 10, nylon 4/6, nylon 10/10, nylon 12, and hydrophilic polyamide copolymers such as copolymers of caprolactam and an alkylene oxide, e.g., ethylene oxide, and copolymers of hexamethylene adipamide and an alkylene oxide, as well as blends and copolymers thereof. Suitable polyesters include polyethylene terephthalate, polybutylene terephthalate, polycyclohexylenedimethylene terephthalate, and blends and copolymers thereof. Acrylic polymers and copolymers suitable for the present invention include polymethyl methacrylate, ethylene acrylic acid, ethylene methacrylic acid, ethylene methylacrylate, ethylene ethylacrylate, ethylene butylacrylate and blends thereof.

The present nonwoven webs may additionally contain minor amounts of other fibers, e.g., natural fibers, filler fibers, bulking fibers and the like, and particulates, e.g., adsorbents, deodorants, carbon black, clay, germicide and the like.

The perforated nonwoven webs of the present invention, which can be controlled to have non-fused perforations of different sizes and shapes, are highly useful for perforated layers of disposable articles. The perforated nonwoven webs are particularly suitable for fluid permeable layers that come in contact with the skin of the user since the perforated nonwoven webs do not contain fused edges that impart rough and sharp textures to the web and interfere with the flow of fluid. The perforated nonwoven web can be laminated to a nonwoven web or a film by any suitable means known in the art to form a composite that is highly suited for absorbent articles, such as diapers. Alternatively, the suitable nonwoven web can be laminated to other layers, such as a film or nonwoven web layer, to form a composite before the composite is subjected to the slit-perforating process of the present invention. An additional advantage of the present invention is that the perforation process provides a means for obtaining substantially uniformly shaped and sized perforations without the complications and difficulties of the prior art perforation processes, unless nonuniform perforations are desired which can be obtained using a slitting pattern having non-uniform sized blades.

The following examples are provided for illustration purposes and the invention is not limited thereto.

EXAMPLES

Example 1

A 3.0 ounce per square yard (osy) conjugate fiber web was fabricated from linear low density polyethylene and polypropylene bicomponent conjugate fibers. The fibers had a round side-by-side configuration and a 1:1 weight ratio of the two component polymers. The bicomponent fiber web was produced with the process disclosed in European Patent Application 0 586 924 to Kimberly-Clark Corp., which is incorporated herein by reference in its entirety. The bicomponent spinning die had a 0.6 mm spinhole diameter and a 6:1 L/D ratio. Linear low density polyethylene (LLDPE), Aspun 6811A, which is available from Dow Chemical, was blended with 2 wt % of a $TiO_2$ concentrate containing 50 wt % of $TiO_2$ and 50 wt % of polypropylene, and the mixture was fed into a first single screw extruder. Polypropylene, PD3445, which is available from Exxon, was blended with 2 wt % of the above-described $TiO_2$ concentrate, and the mixture was fed into a second single screw extruder. The melt temperatures. of the polymers fed into the spinning die were kept at 450° F., and the spinhole throughput rate was 0.5 gram/hole/minute. The bicomponent fibers exiting the spinning die were quenched by a flow of air having a flow rate of 45 SCFM/inch spinneret width and a temperature of 65° F. The quenching air was applied about 5 inches below the spinneret. The quenched fibers were drawn in the aspirating unit using a flow air heated to about 350° F. and had a flow rate of about 19 $ft^3$/min/inch width. Then, the drawn, highly crimped fibers were deposited onto a foraminous forming surface with the assist of a vacuum flow to form an unbonded fiber web. The unbonded fiber web was bonded by passing it through a through-air bonder. The bonder treated the fiber web with a flow of heated air having a temperature of about 270° F. and a flow rate of about 200 feet/min.

The bonded web was cooled and then slit with a rotary die having a slit pattern as illustrated in FIG. 4. The rotary die contained regularly, radially placed blades that formed a 3 inch wide slit pattern, in which the length of each slit was ⅜ of an inch, the vertical distance between the successive slits was ¼ of an inch, and the horizontal distance between columns of slits was ⅛ of an inch. The slit web was stretched in the direction which is perpendicular to the length of the slits until the width of the slit pattern attained 6.625 inches. The stretched web was securely clipped to an aluminum frame and placed in a convection oven which was kept at about 212° F. for 30 seconds to set the opened perforations. The perforated web was removed from the oven and cooled to ambient temperature.

The cooled perforated web contained permanently opened and self-sustaining circular perforations of an approximately equal size, and the perforations had a diameter of about 0.31 inches. The perforated web exhibited a soft cloth-like texture and the perforations did not contain any melt-fused edge.

Example 2

An unbonded 0.6 osy bicomponent fiber web was produced in accordance with the procedures outlined in Example 1, except the fiber drawing air supplied to the aspirating unit was at ambient temperature. The web was point bonded by passing the web through the nip formed by an embossing roll and a smooth anvil roll. The embossing roll contained regularly spaced oblong bond points and had a bond point density of about 34 points per $cm^2$. Both of the rolls were heated to about 305° F. and the pressure applied on the web was about 500 lbs/linear inch of width.

The bonded web was slit and heat treated as in Example 1, except the 3 inch slit pattern of the slit web was stretched to 5.375 inches and the stretched web was heat treated for 10 seconds.

The cooled perforated web contained permanently opened perforations of an approximately same size ellipse having a 0.31 inch length and a 0.22 inch width. Again, the perforated web exhibited a soft cloth-like texture and the perforations did not contain any melt-fused edge.

Example 3

The 0.6 osy bonded nonwoven web of Example 2 was extrusion coated with LLDPE, Aspun 6811A, to form a film laminate. The film layer had a thickness of about 0.6 mil.

The laminate was slit using a stamping die which had a blade pattern similar to the rotary die of Example 1. The stamping die contained a 1 inch wide regularly repeating pattern of slits in which the length of each slit was ⅛ of an inch, the vertical distance between the successive slits was ⅛ of an inch, and the horizontal distance between two slits was ⅛ of an inch. The slit web was stretched in the direction which is perpendicular to the length of the silts until the width of the slit pattern attained 1.24 inches. The stretched web was heat treated as in Example 2.

The perforated laminate had self-sustaining elliptic holes, which had an about 0.13 inch length and an about 0.03 inch width.

Example 4

An 1 osy point bonded carded web was prepared from 2.8 denier polypropylene staple fibers, which are available from Hercules. The fibers were carded on a foraminous forming wire and then bonded in accordance with the bonding procedure outlined in Example 1. The bonded carded web was slit with a stamping die similar to the die of Example 3. The stamping die contained a 3 inch-wide slit pattern in which the length of each blade was ⅜ of an inch and the vertical distance between the successive slits was ¼ of an inch. The slit web was stretched until the width of the slit pattern reached 4 inches, and then the web was heat treated in accordance with Example 1.

The heat treated web had permanently opened elliptic perforations having a length of about 0.34 inches and a width of about 0.08 inches.

Example 5

An 1 osy point bonded carded web containing 50 wt % polypropylene staple fibers and 50 wt % polyethylene terephthalate staple fibers was prepared. The polypropylene fibers were 2.8 denier fibers and obtained from Hercules, and the polyethylene terephthalate fibers were 6 denier fibers and obtained from Hoechst Celanese. The bonded web was prepared, slit and heat treated in accordance with Example 4, except the slit web was stretched until the slit pattern reached 5.4375 inches and the stretch web was heat treated at 250° F. for 15 seconds.

The perforations in the heat treated and cooled web were, again, approximately same size ellipses having a length of about 0.34 inches and a width of about 0.19 inches.

Control 1

A control sample specimen was prepared in accordance with Example 1. However, the 3 inch slit pattern of the slit web was stretched to about 7 inches. Then the stretching tension was released and the web was placed in ambient environment.

Upon releasing the tension, the opened 7 inch perforation pattern immediately closed to about 4.75 inches. In 10 minutes the perforation pattern further relaxed to 3.75 inches, and each perforation attained an elliptic shape having a length of about 0.34 inches and a width of about 0.06. The stretch-opened perforations continuously relaxed and almost completely closed within 24 hours.

The perforation process of the present invention is an uncomplicated and flexible process that can be utilized to provide self-sustaining perforations in a bonded nonwoven web without deleteriously effecting the textural properties of the web. In addition, the perforation process is a flexible process that can easily vary the size and shape of the perforation pattern in the web to accommodate diverse uses of the perforated nonwoven webs.

What is claimed is:

1. A process for producing a fluid permeable perforated nonwoven web of a thermoplastic polymer comprising the steps of slitting a bonded nonwoven web in a predetermined pattern, heating said web to a temperature between the softening temperature and about the onset of melting at a liquid fraction of 5% of said thermoplastic polymer, tensioning said web in at least one planar direction of said web to form apertures, and cooling the apertured web while maintaining the tension, wherein said perforation process imparts permanently opened and self sustaining apertures without melt-fusing the fibers at the edge of said apertures.

2. The process for producing a perforated nonwoven web of claim 1 wherein said thermoplastic polymer is selected from the group consisting of polyolefins, polyamides, polyesters, acrylic polymers, polycarbonate, fluoropolymers, thermoplastic elastomers, and blends and copolymers thereof.

3. The process for producing a perforated nonwoven web of claim 1 wherein said thermoplastic polymer is a polyolefin polymer.

4. The process for producing a perforated nonwoven web of claim 1 wherein said nonwoven web is fabricated from multicomponent conjugate fibers.

5. The process for producing a perforated nonwoven web of claim 1 wherein the slit web is heated with a heating process selected from the group consisting of oven heating, infrared heating, conduction heating and through-air heating processes.

6. The process for producing a perforated nonwoven web of claim 1 wherein the slit web is heated with a through-air heating process.

7. The process for producing a perforated nonwoven web of claim 1 wherein said predetermined slitting pattern is a regularly-spaced, repeating pattern of linear slits.

8. The process for producing a perforated nonwoven web of claim 1 wherein said predetermined slitting pattern is effected by a slitting roll assembly comprising a slitting roll and a backing roll.

9. The process for producing a perforated nonwoven web of claim 1 wherein the perforated web is further tensioned to reduce the thickness of said web.

10. The process for producing a perforated nonwoven web of claim 1 wherein the tensioning step precedes the heating step.

* * * * *